United States Patent [19]

Reid

[11] Patent Number: 4,752,374

[45] Date of Patent: Jun. 21, 1988

[54] PROCESS FOR MINIMIZING FOULING OF PROCESSING EQUIPMENT

[75] Inventor: Dwight K. Reid, Houston, Tex.

[73] Assignee: Betz Laboratories, Inc., Trevose, Pa.

[21] Appl. No.: 40,408

[22] Filed: Apr. 20, 1987

[51] Int. Cl.[4] ..... C10G 9/12

[52] U.S. Cl. ..... 208/48 AA; 585/950; 252/389.24; 44/66; 208/255; 208/256

[58] Field of Search ..... 208/48 AA, 255, 256; 585/950; 252/389.24; 44/66

[56] References Cited

U.S. PATENT DOCUMENTS

| | | | |
|---|---|---|---|
| Re. 29,488 | 12/1977 | Gautreaux | 44/68 |
| 2,363,778 | 11/1944 | Pedersen | 44/63 |
| 2,375,218 | 5/1945 | Fry et al. | 51/281 |
| 2,405,560 | 8/1946 | Campbell | 44/69 |
| 2,427,173 | 9/1947 | Withrow | 44/69 |
| 2,678,262 | 5/1954 | Neely et al. | 44/76 |
| 2,695,223 | 11/1954 | Bartleson | 44/76 |
| 2,728,789 | 12/1955 | Morris et al. | 252/389.24 |
| 2,765,221 | 10/1956 | Lusebrink et al. | 44/76 |
| 2,839,563 | 6/1958 | Hechenbleikner | 260/461 |
| 2,841,480 | 7/1958 | Yust et al. | 44/63 |
| 2,847,443 | 8/1958 | Hechenbleikner et al. | 260/461 |
| 2,876,246 | 3/1959 | Pianfetti et al. | 260/461 |
| 2,889,212 | 6/1959 | Yust et al. | 44/69 |
| 2,985,522 | 5/1961 | Binning et al. | 44/70 |
| 2,993,766 | 7/1961 | Fowler | 44/70 |
| 2,993,772 | 7/1961 | Stromberg | 52/0.5 |
| 2,999,739 | 9/1961 | Heron | 44/69 |
| 3,013,869 | 12/1961 | Kissa | 44/66 |
| 3,034,876 | 5/1962 | Gee et al. | 44/62 |
| 3,068,083 | 12/1962 | Gee et al. | 44/70 |
| 3,192,243 | 6/1965 | Gagliani | 260/461 |
| 3,281,359 | 10/1966 | Oberender et al. | 252/46.6 |
| 3,309,431 | 3/1967 | Olivette et al. | 260/976 |
| 3,328,285 | 6/1967 | Godur | 208/48 AA |
| 3,356,617 | 12/1967 | Juredine | 252/389.24 |
| 3,419,367 | 12/1968 | Eckert et al. | 44/60 |
| 3,531,394 | 9/1970 | Koszman | 208/48 |
| 3,558,470 | 1/1971 | Gillespie et al. | 208/48 AA |
| 3,591,484 | 7/1971 | Peck et al. | 208/48 AA |
| 3,645,886 | 2/1972 | Gillespie et al. | 208/48 AA |
| 3,647,677 | 3/1972 | Wolff et al. | 208/48 AA |
| 3,717,691 | 2/1973 | Howell et al. | 260/956 |
| 3,751,372 | 8/1973 | Zecher | 252/181 |
| 3,807,974 | 4/1974 | Kerley et al. | 44/58 |
| 4,024,048 | 5/1978 | Shell et al. | 208/48 AA |
| 4,024,048 | 5/1977 | Shell et al. | 208/48 AA |
| 4,024,050 | 5/1977 | Shell et al. | 208/48 AA |
| 4,024,051 | 5/1977 | Shell et al. | 208/48 AA |
| 4,105,540 | 8/1978 | Weinland | 208/48 AA |
| 4,216,076 | 8/1980 | Dillon et al. | 208/48 AA |
| 4,226,700 | 10/1980 | Broom | 208/48 AA |
| 4,263,131 | 4/1981 | Bertus et al. | 208/48 AA |
| 4,425,223 | 1/1984 | Miller | 208/48 AA |
| 4,542,253 | 9/1985 | Kaplan et al. | 585/950 |
| 4,569,750 | 2/1986 | Brownawell et al. | 585/950 |
| 4,578,178 | 3/1986 | Forester | 208/48 AA |
| 4,588,415 | 5/1986 | Zaweski et al. | 44/57 |
| 4,618,411 | 10/1986 | Dickakian | 208/48 AA |
| 4,619,756 | 10/1986 | Dickakian | 208/48 AA |

FOREIGN PATENT DOCUMENTS

| | | | |
|---|---|---|---|
| 1205768 | 6/1986 | Canada | 208/48 AA |

*Primary Examiner*—H. M. S. Sneed
*Assistant Examiner*—Helane Myers
*Attorney, Agent, or Firm*—Alexander D. Ricci; Bruce E. Peacock

[57] ABSTRACT

This invention relates to processes for inhibiting the degradation, particulate and gum formation of distillate fuel oils prior to or during processing which comprises adding to the distillate fuel oil an effective inhibiting amount of a mixture of (a) a phosphite compound having the formula

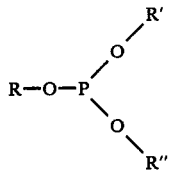

wherein R, R' and R'' are the same or different and are alkyl, aryl, alkaryl or aralkyl groups, and (b) an effective carboxylic acid having from 2 to about 20 carbon atoms, wherein the weight ratio of (a):(b) is from about 1:5 to about 1000:1.

26 Claims, No Drawings

PROCESS FOR MINIMIZING FOULING OF PROCESSING EQUIPMENT

BACKGROUND OF THE INVENTION

1. Field of the Invention

This invention relates to antifoulants and to a process for inhibiting or preventing fouling in refinery and petrochemical feedstocks during processing. More particularly, this invention relates to inhibiting distillate fuel fouling, manifested by color degradation, particulate formation and gum generation in distillate fuel oils.

2. Description of the Prior Art

During hydrocarbon processing, transportation and storage, the hydrocarbons deteriorate, particularly when subjected to elevated temperatures. The deterioration usually results in the formation of sediment, sludge or gum and can manifest itself visibly by color deterioration. Sediment, sludge or gum formation may cause clogging of equipment or fouling of processing equipment (such as heat exchangers, compressors, furnaces, reactors and distillation systems, as examples). The fouling can be caused by the gradual accumulation of high molecular weight polymeric material on the inside surfaces of the equipment. As fouling continues, the efficiency of the operation associated with hydrocarbon processing equipment such as heat exchangers, compressors, furnaces, reactors and distillation systems decreases. The distillate streams which can result in significant fouling include the straight-run distillates (kerosene, diesel, jet), naphthas, lube oils, catalytic cracker feedstocks (gas oils), light and heavy cycle oils, coker naphthas, resids and petrochemical plant feedstocks.

The precursors leading to the formation of the foulants may form in tankage prior to hydrocarbon processing. Unstable components may include such species as oxidized hydrocarbons (for example, aldehydes and ketones), various organosulfur compounds, olefinic hydrocarbons, various inorganic salts and corrosion products.

Suggestions of the prior art for inhibiting the fouling rate in process heat transfer equipment include U.S. Pat. No. 3,647,677, Wolff et al., which discloses the use of a coke retarder selected from the group consisting of elemental phosphorus and compounds thereof to retard the formation of coke in high-temperature petroleum treatments.

Additionally, U.S. Pat. No. 3,558,470, Gillespie et al., teaches a method of treating mineral hydrocarbon feedstocks subjected to elevated temperatures of the order of 200° to 1300° F. and which have a tendency to form deposits by reason of such heating by adding thereto minor amounts of a certain condensation product of a long chain alkyl or alkenyl monocarboxylic acid, dicarboxylic acid or anhydride thereof, having a number average molecular weight between about 600 and about 5,000, and at least one polyalkylene polyamine and an additional small amount of a certain phosphorous acid or a certain mono-, di- or tri- organic phosphite ester. Of particular interest is U.S. Pat. No. 3,645,886, Gillespie et al., which discloses the use of a certain mixture of a fatty acid ester of an alkanolamine and a certain phosphorous acid or a certain mono-, di-, or tri-organic phosphite ester, to reduce or prevent the fouling of process equipment in petroleum or chemical industries wherein an organic feedstock is subjected to heat exchange at a temperature of from about 200° to about 1300° F.

Also, U.S. Pat. No. 4,024,048, Shell et al., teaches that certain phosphate and phosphite mono- and di-esters and thioesters in small amounts function as antifoulant additives in overhead vacuum distilled gas oils employed as feedstocks in hydrosulfurizing wherein such feedstocks are subjected to elevated temperatures of from about 200° to 700° F. U.S. Pat. No. 4,024,049, Shell et al., teaches that certain thio-phosphate and -phosphite mono- and di-esters in small amounts function as antifoulant additives in crude oil systems employed as feedstocks in petroleum refining which are subjected to elevated temperatures of from about 100° to 1500° F. Furthermore, U.S. Pat. No. 4,024,050, Shell et al., teaches that certain phosphate and phosphite mono- and di-esters in small amounts function as antifoulant additives in crude oil systems employed as feedstocks in petroleum refining which are subjected to elevated temperatures of from about 100° to 1500° F. U.S. Pat. No. 4,024,051, Shell et al., teaches the use of certain phosphorous acids or their amine salts as antifoulants in petroleum refining processes. U.S. Pat. No. 4,226,700, Broom, discloses a method for inhibiting the formation of foulants on petrochemical equipment which involves adding to the petrochemical, during processing, a composition comprising a thiodipropionate and either a certain dialkyl acid phosphate ester or a certain dialkyl acid phosphite ester. Moreover, U.S. Pat. No. 4,425,223, Miller, discloses that hydrocarbon process equipment is protected against fouling during processing of high sulfur-containing hydrocarbon feed stocks by incorporating into the hydrocarbon being processed small amounts of a composition comprised of a certain alkyl ester of a phosphorous acid and a hydrocarbon, surfactant type, sulfonic acid. However, none of these prior art references disclose the unique and effective mixture of a phosphite compound and a carboxylic acid in accordance with the instant invention for inhibiting the degradation, particulate and gum formation of distillate fuel oils prior to and/or during processing.

SUMMARY OF THE INVENTION

This invention relates to processes for inhibiting the degradation, particulate and gum formation of distillate fuel oils prior to or during processing which comprises adding to the distillate fuel oil an effective inhibiting amount of a mixture of (a) a phosphite compound having the formula

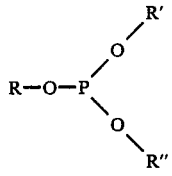

wherein R, R' and R'' are the same or different and are alkyl, aryl, alkaryl or aralkyl groups, and (b) a carboxylic acid having from 2 to about 20 carbon atoms, wherein the weight ratio of (a):(b) is from about 1:5 to about 1000:1. More particularly, the processes of this invention relate to inhibiting the degradation, particulate and gum formation of distillate fuel oils prior to or during processing at elevated temperatures. Generally, the total amount of the mixture of (a) and (b) is from about 1.0 parts to about 10,000 parts per million parts of the fuel oil. It is preferred that the weight ratio of (a):(b) is from about 1:1 to about 200:1. This mixture of (a) and (b) provides an unexpectedly higher degree of inhibition of distillate fuel oil degradation than the individual ingredients comprising the mixture. It is therefore possible to produce a more effective inhibiting process than is obtainable by the use of each ingredient alone. Because of the enhanced inhibiting activity of the mixture, the concentrations of each of the ingredients may be lowered and the total amount of (a) and (b) required for an effective inhibiting and antifoulant treatment may be reduced.

Accordingly, it is an object of the present invention to provide processes for inhibiting the degradation, particulate and gum formation of distillate fuel oils prior to or during processing. It is another object of this invention to inhibit color deterioration of distillate fuel oils. It is a further object of this invention to inhibit fouling in refinery and petrochemical feedstocks (distillate fuel oils) during processing. These and other objects and advantages of the present invention will be apparent to those skilled in the art upon reference to the following description of the preferred embodiments.

DESCRIPTION OF THE PREFERRED EMBODIMENTS

The present invention pertains to a process for inhibiting the degradation, particulate and gum formation of distillate fuel oil, prior to or during processing, particularly at elevated temperatures, wherein the fuel oil has hydrocarbon components distilling from about 100° F. to about 700° F., which comprises adding to the distillate fuel oil an effective inhibiting amount of a mixture of (a) a phosphite compound having the formula

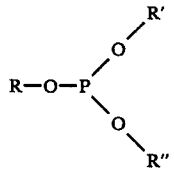

wherein R, R' and R'' are the same or different and are alkyl, aryl, alkaryl or aralkyl groups, and (b) a carboxylic acid having from 2 to about 20 carbon atoms, wherein the weight ratio of (a):(b) is from about 1:5 to about 1000:1. The amounts or concentrations of the two components of this invention can vary depending on, among other things, the tendency of the distillate fuel oil to undergo deterioration or, more specifically, to form particulate matter and/or discolor and subsequently foul during processing. While, from the disclosure of this invention, it would be within the capability of those skilled in the art to find by simple experimentation the optimum amounts or concentrations of (a) and (b) for any particular distillate fuel oil or process, generally the total amount of the mixture of (a) and (b) which is added to the distillate fuel oil is from about 1.0 part to about 10,000 parts per million parts of the distillate fuel oil. Preferably, the mixture of (a) and (b) is added in an amount from about 1.0 part to about 1500 parts per million. It is also preferred that the weight ratio of (a):(b) is from about 1:1 to about 200:1, based on the total combined weight of these two components. More preferably, the weight ratio of (a):(b) is about 20:1 based on the total combined weight of these two components.

The two components, (a) and (b), can be added to the distillate fuel oil by any conventional method. The two components can be added to the distillate fuel oil as a single mixture containing both compounds or the individual components can be added separately or in any other desired combination. The mixture may be added either as a concentrate or as a solution using a suitable carrier solvent which is compatible with the components and distillate fuel oil. The mixture can also be added at ambient temperature and pressure to stabilize the distillate fuel oil during storage and prior to processing. The mixture may be introduced into the equipment to be protected from fouling just upstream of the point of fouling. The mixture is preferably added to the distillate fuel oil prior to any appreciable deterioration of the fuel oil as this will either eliminate deterioration or effectively reduce the formation of particulate matter and/or color deterioration and eliminate or reduce subsequent fouling during processing. However, the mixture is also effective even after some deterioration has occurred.

The alkyl, aryl, alkaryl or aralkyl groups of the phosphite compound of this invention may be straight or branch-chain groups. Preferably, the alkyl, aryl, alkaryl and aralkyl groups have 1 to about 20 carbon atoms and, most preferably, these groups have from 2 to about 10 carbon atoms. Examples of suitable phosphite compounds include: triethylphosphite, triisopropylphosphite, triphenylphosphite, ethylhexyldiphenylphosphite, triisooctylphosphite, heptakis(dipropylene glycol)triphosphite, triisodecylophosphite, tristearylphosphite, trisnonylphenylphosphite, trilaurylphosphite, distearylpentaerythritoldiphosphite, diphenylisodecylphosphite, diphenylisooctylphosphite, poly(dipropylene glycol)-phenylphosphite, diisooctyloctylphenylphosphite and diisodecylpentaerythritoldiphosphite. Preferably, the phosphite compound is selected from the group consisting of triethylphosphite, triphenylphosphite, ethylhexyldiphenylphosphite, triisooctylphosphite, and heptakis(dipropylene glycol)triphosphite.

The carboxylic acid component of this invention has from 2 to about 20 carbon atoms and, preferably, has from 2 to about 10 carbon atoms. The carboxylic acid may be straight or branch-chain, but it is preferred that the carboxylic acid is straight chain. The carboxylic acid may be saturated or unsaturated and may have one or more carboxyl groups as a constituent. It may also be monobasic, dibasic, tribasic, aromatic or heterocyclic and these acids may contain the following groups: alkyl, aryl, alkaryl, aralkyl, hydroxy, and the like. Nevertheless, it should be noted that the carboxyl group is the essential part of the acid utilized in accordance with this invention. Examples of suitable carboxylic acids include: acetic acid, hydroxyacetic acid, pelargonic acid, 2-ethylhexanoic acid, oleic acid, butyric acid, propionic acid, hexanoic acid, pentanoic acid, octanoic acid, decanoic acid, palmitic acid, benzoic acid, toluic acid, phthalic acid and salicyclic acid. Preferably, the carboxylic acid is selected from the group consisting of acetic acid, hydroxyacetic acid, pelargonic acid, 2-ethylhexanoic acid, and oleic acid. Most preferably, the carboxylic acid is acetic acid.

The distillate fuel oils of this invention are those fuel oils having hydrocarbon components distilling from about 100° F. to about 700° F. Included are straight-run fuel oils, thermally cracked, catalytically cracked, thermally reformed, and catalytically reformed oil stocks, naphthas, lube oils, light and heavy cycle oils, coker naphthas, resids and petrochemical plant feedstocks, and blends thereof which are susceptible to deterioration and fouling. Preferably, the distillate fuel oil is a blend or mixture of fuels having hydrocarbon components distilling from about 250° F. to about 600° F.

The processes of the instant invention effectively inhibit the degradation, particulate and gum formation of the distillate fuel oils prior to or during processing, particularly when such fuel oils are subjected to elevated temperatures of from about 100° F. to about 800° F. The term "particulate formation" is meant to include the formation of soluble solids and sediment.

In order to more clearly illustrate this invention, the data set forth below was developed. The following examples are included as being illustrations of the invention and should not be construed as limiting the scope thereof.

EXAMPLES

There are several test methods that are used for determining the stability of distillate fuels and their fouling potential. The 110° F. dark storage test (one week to three months), DuPont F21-61, UOP test method 413, 80° C. test, and the 216° F. test are used to evaluate diesel fuel stability.

Tests were conducted to determine the effect of the components to inhibit color deterioration and solids formation of a fuel containing 30% light cycle oil, 45.5% straight-run diesel and 24.5% kerosene, using the 90 minute, 300° F. accelerated test method. 50 mL of the diesel fuel sample spiked with the appropriate treatment was filtered through a Whatman No. 1 filter paper and into a test tube. The test tube was then supported in an oil bath maintained at 300°±2° F. The bath oil level was kept above the sample level in the test tube. After 90 minutes, the test tube was removed from the oil bath and stored at room temperature for another 90 minutes. The sample was then filtered through a clean Whatman No. 1 filter paper with moderate vacuum. After the filter paper appeared dry, the test tube was washed with mixed hexanes and the washings were transferred to the filter. The washing and transferring steps were repeated once more. Then all traces of the oil were removed from the filter paper by washing it with a stream of mixed hexanes from a wash bottle. The vacuum was maintained until the filter paper was dry. The filter paper was thereafter transferred to a reflectometer where the percent reflectance of the sample was measured. The color of the sample was determined by visual comparison with known standards according to the ASTM-D-1500 procedure, which involved matching the color of the fuel samples with ASTM-1500 color numbers. The results are based on a scale of 0.5 to 8.0 wherein increasing values indicate increasing darkness of the sample. The sediment produced with each sample was also measured. The results obtained are reported in Table I below.

TABLE I

| Sample Description | Sediment Level mg/100 mL | Color Level* ASTM D1500 |
|---|---|---|
| Set 1: | | |
| Untreated | 1.2 | 1.8 |
| Untreated | 1.2 | 2.0 |
| Acetic Acid, 2.5 ppm | 1.8 | 1.8 |
| 2-Ethylhexanoic Acid, 2.5 ppm | 1.4 | 2.0 |
| Set 2: | | |
| Untreated | 1.2 | 2.8 |
| Untreated | 1.6 | 3.0 |

TABLE I-continued

| Sample Description | Sediment Level mg/100 mL | Color Level* ASTM D1500 |
|---|---|---|
| Triphenylphosphite, 50 ppm | 2.0 | 2.0 |
| Heptakis (dipropylene glycol) triphosphite, 50 ppm | 1.4 | 2.0 |
| Heptakis (dipropylene glycol) triphosphite, 50 ppm | 1.6 | 2.3 |
| Triisooctylphosphite, 50 ppm | 1.2 | 2.8 |
| Heptakis (dipropylene glycol) triphosphite, 50 ppm and 2-Ethylhexanoic Acid, 5 ppm | 0.8 | 2.3 |
| 2-Ethylhexanoic Acid, 5 ppm | 4.2 | 2.8 |
| Set 3: | | |
| Untreated | 1.4 | 4.3 |
| Triphenylphosphite, 50 ppm and acetic acid, 2.5 ppm | 0.4 | 2.5 |
| Heptakis (dipropylene glycol) triphosphite, 50 ppm and acetic acid, 2.5 ppm | 0.4 | 1.8 |
| Triisooctylphosphite, 50 ppm and acetic acid, 2.5 ppm | 1.0 | 2.0 |

*Note: The difference in the color level of the untreated sample from Sets 1 to 3 is believed to be due to the effects of standing prior to experimentation.

The results reported in Table I demonstrate the unique and exceptionally effective relationship of the components of this invention since the samples containing both the phosphite compound and carboxylic acid show better overall effectiveness in stabilizing the diesel fuel (inhibiting both color degradation and sediment formation) than was obtainable in using each of the components individually.

Further tests were conducted to determine the effect of the components of this invention to inhibit both color and sediment formation of a diesel fuel sample from a Midwestern refinery containing 25% light cycle oil with the balance being straight-run diesel and kerosene using a seven-day heating period at 175° F. to accelerate degradation. The results obtained are reported in Table II below.

TABLE II

| Sample Description | Sediment Level mg/100 mL | Color Level ASTM D1500 |
|---|---|---|
| Untreated | 10.2 | 3.0 |
| Triethylphosphite, 50 ppm and acetic acid, 2.5 ppm | 1.2 | 2.2 |
| Triisooctylphosphite, 50 ppm and acetic acid, 2.5 ppm | 1.2 | 2.4 |

The results reported in Table II demonstrate the superior efficacy of the phosphite/carboxylic acid combination of this invention.

Additional tests were conducted to study the effect of the phosphite compounds and carboxylic acids to inhibit color deterioration of a diesel fuel sample from a Midwestern refinery containing 20% light cycle oil with the balance being straight-run diesel and kerosene using a twelve-week heating period at 110° F. to accelerate degradation. The results obtained are reported in Table III below.

TABLE III

| Sample Description | Concentration of Additive, ppm | Color Level ASTM D1500 |
|---|---|---|
| Untreated | — | 3.3 |
| Triisooctylphosphite/Acetic Acid | 380/20 | 1.8 |
| | 285/15 | 1.8 |
| | 190/10 | 1.5 |
| | 95/5 | 1.8 |

TABLE III-continued

| Sample Description | Concentration of Additive, ppm | Color Level ASTM D1500 |
|---|---|---|
| Triphenylphosphite/Acetic Acid | 380/20 | 2.5 |
| | 285/15 | 2.3 |
| | 190/10 | 1.0 |
| | 95/5 | 2.0 |
| Ethylhexyldiphenylphosphite/ Acetic Acid | 380/20 | 2.0 |
| | 285/15 | 1.8 |
| | 190/10 | 1.5 |
| | 95/5 | 2.5 |
| Triethylphosphite/Acetic Acid | 380/20 | 2.5 |
| | 285/15 | 1.8 |
| | 190/10 | 1.5 |
| | 95/5 | 1.5 |
| UOP-130 (believed to be an amine based dispersant) | 400 | 5.5 |
| FOA-3 (believed to be a cyclo-alkyl amine) from DuPont | 400 | 3.5 |

The results reported in Table III further demonstrate the substantial efficacy of the phosphite/carboxylic acid combination of this invention for color stability and also show that the instant invention is superior to two other commercially available distillate fuel stabilizers.

Tests were conducted to further study the effect of phosphites and phosphite/carboxylic acid mixture to inhibit both color degradation and sediment formation of a diesel fuel sample from a Midwestern refinery containing 20%–30% light cycle oil with the balance being straight-run diesel and kerosene using a twelve-week heating period at 110° F. to accelerate degradation. The results obtained are reported in Table IV below.

TABLE IV

| Sample Description | Sediment Level ppm | Color Level ASTM D1500 |
|---|---|---|
| 20% LCO: Untreated | 2.4 | 4.0 |
| Triethylphosphite, 300 ppm | 4.0 | 3.2 |
| Triethylphosphite/acetic acid at 105/20 ppm | 0.8 | 3.5 |
| Triethylphosphite/acetic acid at 250/50 ppm | 1.2 | 3.5 |

The results reported in Table IV also indicate that the carboxylic acids, when combined with the phosphites, effectively inhibit sediment formation and color degradation.

Tests were also conducted to study the effect of various additives to inhibit color degradation and sediment formation of a diesel fuel sample from a Midwestern refinery containing 20% light cycle oil with the balance being straight-run diesel and kerosene using a seven-day heating period at 175° F. to accelerate degradation. The results obtained are reported in Table V below.

TABLE V

| Sample Description | Active Concentration, ppm | Sediment Level mg/100 mL | Color Level ASTM D1500 |
|---|---|---|---|
| Untreated | 0 | 1.0 | 1.8 |
| | 0 | 1.0 | 1.8 |
| Triisooctylphosphite/ acetic acid | 200/0 | 1.0 | 1.3 |
| | 400/0 | 2.8 | 1.3 |
| | 600/0 | 3.8 | 1.3 |
| | 190/10 | 0.6 | 1.3 |
| | 380/20 | 1.2 | 1.3 |
| | 570/30 | 0.8 | 1.5 |
| | 167/33 | 1.4 | 1.5 |
| | 333/67 | 2.0 | 1.8 |
| | 500/100 | 1.8 | 2.0 |
| Ethylhexyldiphenyl-phosphite/acetic acid | 190/10 | 0.8 | 1.3 |
| | 380/20 | 0.4 | 1.5 |
| | 570/30 | 0.4 | 1.8 |
| | 167/33 | 0.6 | 1.8 |
| | 333/67 | 1.2 | 1.8 |
| | 500/100 | 0.4 | 1.8 |
| Triisooctylphosphite/ nonanoic acid/a phenolic dispersant | 361/19/20 | 1.2 | 1.3 |
| | 342/18/40 | 1.4 | 1.5 |

The results reported in Table V indicate that the phosphite/carboxylic acid mixture is effective at inhibiting sediment formation and color deterioration.

Tests were conducted to study color degradation and sediment formation of a diesel fuel from a Midwestern refinery containing 20% light cycle oil with the balance being straight-run diesel and kerosene using an eighty-eight hour heating period at 210° F. to accelerate degradation (UOP-413 Test). The results obtained are reported in Table VI below.

TABLE VI

| Sample Description | Active Concentration, ppm | Sediment Level mg/100 mL | Color Level ASTM D1500 |
|---|---|---|---|
| Untreated | 0 | 0.3 | not recorded |
| | 0 | 0.3 | not recorded |
| Triisooctylphosphite/ pelargonic acid | 285/15 | 0.4 | not recorded |
| | 285/15 | 0.4 | not recorded |

For completeness, all data obtained during these experiments has been included. Efforts to exclude any value outside acceptable test error limits have not been made. It is believed that, during the course of these experiments, possible errors in preparing samples and in making measurements may have been made which may account for the occasional data point that is not supportive of this art.

Tests were conducted to study the effect of phosphites and phosphite/carboxylic acid mixture to inhibit sediment formation of a diesel fuel sample from a Mid-Atlantic Coast refinery containing 50% light cycle oil with the balance being straight-run diesel and kerosene using a twelve-week heating period at 110° F. to accelerate degradation. The results obtained are reported in Table VII below.

TABLE VII

| Sample Description | Concentration of Additive, ppm | Sediment Level mg/100 mL |
|---|---|---|
| Untreated | — | 2.4 |
| Untreated | — | 2.6 |
| Triphenylphosphite/acetic acid | 350/0 | 2.0 |
| | 333/67 | 1.8 |
| | 250/50 | 1.2 |
| | 167/33 | 1.0 |
| | 83/17 | 1.4 |
| Triisooctylphosphite/acetic acid | 350/0 | 3.4 |
| | 260/0 | 2.8 |
| | 100/0 | 2.4 |
| | 333/67 | 1.8 |
| | 250/50 | 2.4 |
| | 83/17 | 2.6 |
| Ethylhexyldiphenylphosphite/ acetic acid | 333/67 | 1.4 |
| | 250/50 | 1.0 |
| | 167/33 | 0.6 |
| | 83/17 | 2.8 |
| Ethylhexyldiphenylphosphite/ 2-ethylhexanoic acid | 333/67 | 3.4 |
| | 250/50 | 3.0 |

TABLE VII-continued

| Sample Description | Concentration of Additive, ppm | Sediment Level mg/100 mL |
|---|---|---|
| | 167/33 | 2.0 |
| | 83/17 | 2.4 |

The results reported in Table VII indicate the substantial efficacy (with the exception of the last example) of the phosphite/carboxylic acid mixture to inhibit sediment formation. It is believed that, during the course of these experiments, possible errors in preparing samples and in making measurements may have been made which may account for the occasional data point that is not supportive of this art.

Additional tests were conducted to determine the effect of phosphites and phosphite/carboxylic acid mixture to inhibit color degradation and sediment formation of a diesel fuel sample from a Mid-Atlantic Coast refinery containing 50% light cycle oil with the balance being straight-run diesel and kerosene using a seven-day heating period at 175° F. to accelerate degradation. The results obtained are reported in Table VIII below.

TABLE VIII

| Sample Description | Concentration of Additive, ppm | Sediment Level mg/100 mL | Color Level ASTM D1500 |
|---|---|---|---|
| Untreated | — | 2.5 | 3.0 |
| Untreated | — | 2.6 | 3.2 |
| Ethylhexyldiphenyl- | 350/0 | 2.2 | 1.5 |
| phosphite/acetic | 333/67 | 0.8 | 1.8 |
| acid | 250/50 | 1.0 | 2.0 |
| Triphenylphosphite/ | 350/0 | 2.6 | 2.0 |
| acetic acid | 167/33 | 1.0 | 2.0 |
| | 83/17 | 1.2 | 1.8 |

The results reported in Table VIII reveal that the phosphites, when used alone, were able to provide some stabilization of the fuel's color, but they failed to effectively inhibit sediment formation. However, the phosphite/carboxylic acid mixture effectively inhibited both the degradation of color and sediment formation.

Further tests were conducted to study the effect of phosphites and phosphite/carboxylic acid mixture to inhibit color degradation and sediment formation of a diesel fuel sample from a Southern refinery containing 18% light chycle oil with the balance being straight-run diesel and kerosene using a twelve-week heating period at 110° F. to accelerate degradation. The results obtained are reported in Table IX below.

TABLE IX

| Sample Description | Sediment Level mg/100 mL | Color Level ASTM D1500 |
|---|---|---|
| Untreated | 7.8 | 4.5 |
| Triisooctylphosphite, 300 ppm | 2.8 | 4.3 |
| Triisooctylphosphite, 285 ppm and acetic acid, 15 ppm | 2.0 | 4.3 |

The results reported in Table IX show that the phosphite/carboxylic acid mixture was more effective in stabilizing the fuel sample than the phosphite when used alone.

Tests were conducted to determine the effect of various additives on the relative amount of sediment formed in a jet fuel from a West Coast refinery when heated at 385° F. for 22 hours as a 25/75 solution in heptane. 100 mL of the fuel was dosed with the appropriate additive. The mixture was then heated to reflux (385° F.) in air for 22 hours. A 25-mL aliquot of the refluxed material was thereafter mixed with 75 of heptane in a calibrated tube, the solid formed was centrifuged, and the amount of solid was then recorded. The results obtained are reported in Table X below.

TABLE X

| Additive | Concentration (ppm) | Relative Amount of Sediment |
|---|---|---|
| None (not heated) | — | <0.01 |
| None (heated 7 hours) | — | 0.04 |
| None (heated 22 hours) | — | 0.08(1) |
| $H_2SO_4$ (heated 7 hours) | 100 | 0.02 |
| Triisooctylphosphite | 50 | 0.04 |
| Triisooctylphosphite/acetic acid | 50/2.5 | 0.02 |

(1)Average of three measurements

Tests were also conducted to study the effect of various additives on the amount of gum formed in a furnace oil when heated at a temperature of 405° F. for 16 hours to accelerate degradation. The results obtained are reported in Table XI below.

TABLE XI

| Additive | Concentration (ppm) | Washed Gums (mg/50 mL) |
|---|---|---|
| None | — | 524 |
| | — | 654 |
| | — | 713 |
| | — | 622 |
| | Average: | 628 ± 79 |
| Acetic Acid | 35 | 636 |
| Ethylhexyldiphenylphosphite | 350 | 382 |
| Ethylhexyldiphenylphosphite/ | 100/17 | 195 |
| Acetic Acid | 350/100 | 378 |
| Ethylhexyldiphenylphosphite/ | 100/100 | 293 |
| Oleic Acid | 350/100 | 364 |
| Triisooctylphosphite/Acetic Acid | 100/100 | 400 |
| Triisooctylphosphite/Oleic Acid | 150/300 | 345 |
| Triphenylphosphite/Pelargonic Acid | 150/300 | 878 |

Tests were conducted to study the effect of phosphite/carboxylic acids on the amount of gum formed in various fuels. The results obtained are reported in Table XII below.

TABLE XII

| | Fuel Description | Condition of Study | Additive | Concentration (ppm) | Washed Gums (mg/100 mls) |
|---|---|---|---|---|---|
| (1) | Canadian synfuel | Refluxed in air at 203° F. for 16 hours after 7 days' storage at room temperature | Ethylhexyldiphenylphosphite/acetic acid | 420/80 | 252 |
| | | | Untreated | — | 336 |

TABLE XII-continued

| | Fuel Description | Condition of Study | Additive | Concentration (ppm) | Washed Gums (mg/100 mls) |
|---|---|---|---|---|---|
| (2) | Distilled Canadian Synfuel | Refluxed in air at 392° F. for 16 hours | Ethylhexyldiphenylphosphite/acetic acid | 420/80 | 96 |
| | | | | 840/160 | 134 |
| | | | Untreated | — | 145 |
| | | Refluxed in air at 392° F. for 16 hours after 14 days' storage at room temperature | Ethylhexyldiphenylphosphite/acetic acid | 420/80 | 154 |
| | | | Untreated | — | 238 |
| (3) | Distillate hydrotreater feedstock from a Western Refiner | Reflux in air at 248° F. for 16 hours | Ethylhexyldiphenylphosphite/acetic acid | 252/48 | 26 |
| | | | Untreated | — | 52 |
| (4) | Same as 3 but from a different unit | Same as 3 | Ethylhexyldiphenylphosphite/acetic acid | 168/32 | 98 |
| | | | Untreated | — | 400 |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for inhibiting the degradation, particulate and gum formation of distillate fuel oils prior to or during processing which comprises adding to the distillate fuel oil an effective inhibiting amount of a mixture of (a) a phosphite compound having the formula

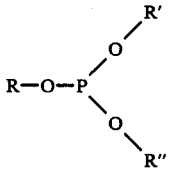

wherein R, R′ and R″ are the same or different and are alkyl, aryl, alkaryl or aralkyl groups, and (b) a carboxylic acid having from 2 to about 20 carbon atoms, wherein the weight ratio of (a):(b) is from about 1:5 to about 1000:1.

2. The process of claim 1 wherein said mixture is added in an amount from about 1.0 part to about 10,000 parts per million parts of said fuel oil.

3. The process of claim 1 wherein said mixture is added at elevated temperatures.

4. The process of claim 1 wherein said mixture is added to said fuel oil prior to deterioration of the fuel oil.

5. The process of claim 1 wherein said (a) phosphite compound is selected from the group consisting of triethylphosphite, triphenylphosphite, ethylhexyldiphenylphosphite, and triisooctylphosphite.

6. The process of claim 1, 5, or 23 wherein said (b) carboxylic acid is selected from the group consisting of acetic acid, hydroxyacetic acid, pelargonic acid, 2-ethylhexanoic acid and oleic acid.

7. The process of claim 6 wherein the weight ratio of (a):(b) is from about 1:1 to about 200:1.

8. The process of claim 6 wherein the distillate fuel oil is a blended diesel fuel.

9. The process of claim 8 wherein said mixture is added in an amount from about 1.0 part to about 1,500 parts per million parts of said fuel oil.

10. A process for inhibiting the degradation, particulate and gum formation of blended diesel fuel during processing at elevated temperatures which comprises adding to said diesel fuel an effective amount of a mixture of (a) a phosphite compound selected from the group consisting of triethylphosphite, triphenylphosphite, ethylhexyldiphenylphosphite, triisooctylphosphite and heptakis(dipropylene glycol)triphosphite, and (b) a carboxylic acid selected from the group consisting of acetic acid, hydroxyacetic acid, pelargonic acid, 2-ethylhexanoic acid and oleic acid, wherein the weight ratio of (a):(b) is from about 1:5 to about 1000:1.

11. The process of claim 10 wherein said mixture is added in an amount from about 1.0 part to about 10,000 parts per million parts of said diesel fuel.

12. The process of claim 11 wherein said mixture is added at elevated temperatures of from about 100° F. to about 800° F.

13. The process of claim 11 wherein said mixture is added to said fuel oil prior to deterioration of the fuel oil.

14. The process of claim 11 wherein the weight ratio of (a):(b) is from about 1:1 to about 200:1.

15. The process of claim 14 wherein said mixture is added in an amount from about 1.0 part to about 1,500 parts per million parts of said fuel oil.

16. The process of claim 10 wherein said (b) carboxylic acid is acetic acid.

17. The process of claim 16 wherein said (a) phosphite compound is triethylphosphite.

18. The process of claim 16 wherein said (a) phosphite compound is triphenylphosphite.

19. The process of claim 16 wherein said (a) phosphite compound is ethylhexyldiphenylphosphite.

20. The process of claim 16 wherein said (a) phosphite compound is triisooctylphosphite.

21. The process of claim 16 wherein said (a) phosphite compound is heptakis(dipropylene glycol)triphosphite.

22. The process of claim 17, 18, 19, 20 or 21 wherein the weight ratio of (a):(b) is about 20:1.

23. A process for inhibiting the degradation, particulate and gum formation of distillate fuel oils prior to or during processing which comprises adding to the distillate fuel oil an effective inhibiting amount of (a) heptakis(dipropylene glycol)triphosphite and (b) a carboxylic acid having from 2 to about 20 carbon atoms, wherein the weight ratio of (a):(b) is from about 1:5 to about 1000:1.

24. The process of claim 23 wherein said mixture is added in an amount from about 1.0 part to about 10,000 parts per million parts of said fuel oil.

25. The process of claim 23 wherein said mixture is added at elevated temperatures.

26. The process of claim 23 wherein said mixture is added to said fuel oil prior to deterioration of the fuel oil.

* * * * *